United States Patent [19]

Sunada

[11] Patent Number: 4,655,114

[45] Date of Patent: Apr. 7, 1987

[54] TONE GENERATING APPARATUS

[75] Inventor: Takuya Sunada, Tokyo, Japan

[73] Assignee: Casio Computer Co., Ltd., Tokyo, Japan

[21] Appl. No.: 633,189

[22] Filed: Jul. 23, 1984

[30] Foreign Application Priority Data

Jul. 30, 1983 [JP] Japan ..... 58-139823

[51] Int. Cl.[4] ..... G10H 1/02; G10H 3/00

[52] U.S. Cl. ..... 84/1.19; 84/1.1; 84/1.11

[58] Field of Search ..... 84/1.1, 1.19, 1.11

[56] References Cited

U.S. PATENT DOCUMENTS

| | | | |
|---|---|---|---|
| 4,067,253 | 1/1978 | Wheelwright et al. | 84/1.1 |
| 4,077,294 | 3/1978 | Hiyoshi et al. | 84/1.23 |
| 4,138,915 | 2/1979 | Nagai et al. | 84/1.19 X |
| 4,176,577 | 12/1979 | Yamada et al. | 84/1.19 |
| 4,383,462 | 5/1983 | Nagai et al. | 84/1.26 |
| 4,419,919 | 12/1983 | Kashio | 84/1.19 X |
| 4,440,056 | 4/1984 | Kozuki et al. | 84/1.1 X |
| 4,493,237 | 1/1985 | DeLong et al. | 84/1.1 X |
| 4,506,581 | 3/1985 | Sunada | 84/1.1 |
| 4,528,885 | 7/1985 | Chihana | 84/1.1 |
| 4,552,051 | 11/1985 | Takeuchi | 84/1.1 X |

FOREIGN PATENT DOCUMENTS

| | | |
|---|---|---|
| 2709530 | 9/1977 | Fed. Rep. of Germany . |
| 2715510 | 10/1977 | Fed. Rep. of Germany . |
| 2937256 | 3/1980 | Fed. Rep. of Germany . |

*Primary Examiner*—William M. Shoop, Jr.
*Assistant Examiner*—Sharon D. Logan
*Attorney, Agent, or Firm*—Frishauf, Holtz, Goodman & Woodward

[57] ABSTRACT

A plurality of envelope generating circuits provide output envelope waveforms which are controlled according to the output from a plurality of timbre switches. The envelope waveform of at least one of the envelope generating circuits is modified according to a touch data output of a touch data detecting circuit for detecting a way of operation of a performance key.

4 Claims, 39 Drawing Figures

TONE GENERATING APPARATUS

BACKGROUND OF THE INVENTION

This invention relates to a tone generating apparatus, with which the volume and timbre of musical tones are controlled according to the way of operation of performance keys on a keyboard.

Heretofore, there have been known keyboard type electronic musical instruments, in which data representing the way of depression of performance keys by performer's fingers is detected and the output volume of a volume control circuit consisting of a VCA (voltage controlled amplifier) is controlled according to the detected data. Also, there have been known electronic musical instruments, in which tone waveforms obtained from a tone generating circuit are controlled to control tone signals, particularly attack portions thereof.

In these prior art electronic musical instruments, however, either the volume is controlled solely without control of timbre so that the musical expression obtainable is rather poor, or the volume is not controlled although the timbre is controlled, or the timbre is controlled only poorly despite the complicated timbre control circuit construction.

SUMMARY OF THE INVENTION

An object of the invention is to provide a tone generating apparatus, which can richly control both the volume and timbre according to the way of operation of performance keys with a comparatively simple circuit construction.

According to the invention, the above object is attained by a tone generating apparatus, which comprises means for sequentially generating waveform data comprising of a plurality of steps, means for generating a plurality of envelope waveform data, means for generating a tone signal having a tone waveform obtained through selective control of the individual steps of said waveform data with the plurality of envelope waveform data, means for generating touch data in accordance with a manner of operation of performance keys, and means for controlling at least one of the plurality of envelope waveform data according to the touch data.

BRIEF DESCRIPTION OF THE DRAWINGS

FIGS. 13 through 25 illustrate a second embodiment, in which:

FIG. 13 is a block diagram showing the circuit of the second embodiment;

FIG. 14 is a schematic representation of first and second envelope generating circuits;

FIG. 15 is a graph showing the transformation characterisistics of first and second data transforming units;

FIGS. 16 to 20 are views showing different variations of tone waveform when a key is depressed strongly, a little strongly, moderately, a little weakly and weakly, respectively, in case where the waveform of FIG. 3 is modified with the envelope waveforms of FIGS. 4A and 4B; and FIGS. 21 to 25 are views showing different variations of tone waveform when a key is depressed strongly, a little strongly, moderately, a little weakly and weakly, respectively, in case where the waveform of FIG. 8 is modified with the envelope waveforms of FIGS. 9A and 9B;

FIGS. 26 through 30 illustrate a third embodiment of the invention, in which:

FIG. 26 is a block diagram showing the circuit of the third embodiment;

FIGS. 28 to 30 are views showing different variations of tone waveform when a key is depressed strongly, moderately and weakly, respectively, in case where the waveforms of FIGS. 27A and 27B are modified with the envelope waveforms of FIGS. 4A and 4B; and FIGS. 31 through 36 illustrate a fourth embodiment, in which:

FIG. 31 is a block diagram showing the circuit of the fourth embodiment; and FIGS. 32 to 36 are views showing different variations of tone waveform when a key is depressed strongly, a little strongly, moderately, a little weakly and weakly, respectively, in case where the waveforms of FIGS. 27A and 27B are modified with the envelope waveforms of FIGS. 4A and 4B.

DETAILED DESCRIPTION OF THE PREFERRED EMBODIMENTS

Now, preferred embodiments of the invention will be described with reference to the accompanying drawings. FIGS. 1 to 12 show a first embodiment of the invention.

Figure 1:
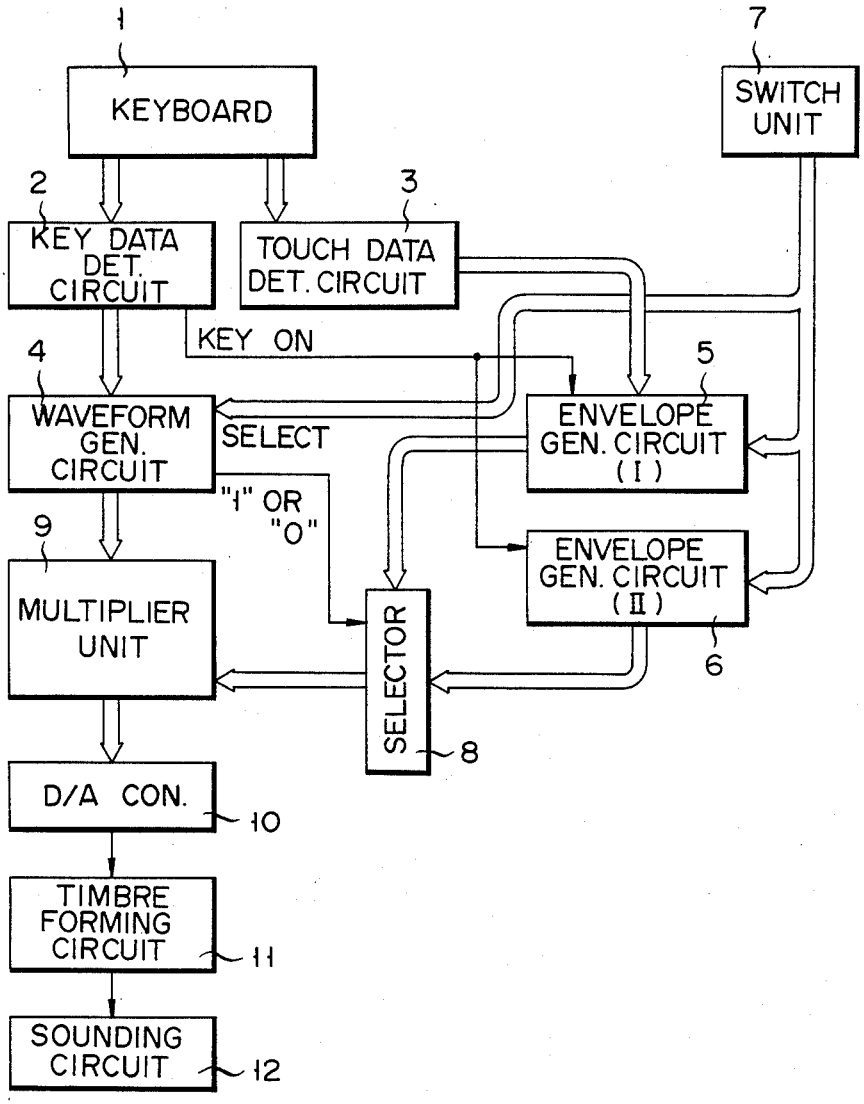
FIG. 1 is a block diagram showing the circuit construction of a first embodiment of the invention.

Referring to FIG. 1, a keyboard 1 has a plurality of performance keys as in the usual electronic musical instrument. The output signals from the individual performance keys are scanned by a CPU (not shown) to be fed to a key data detecting circuit 2 and a touch data detecting circuit 3. Of the output signals from the performance keys, key data representing the pitch of operated keys are detected by the key data detecting circuit 2 to be fed to a waveform generating circuit 4. The key data detecting circuit 2 also provides a key-on signal representing that at least one of the performance keys of the keyboard 1 has been operated. The key-on signal is fed to first and second envelope generating circuits 5 and 6. The key-on signal may be provided, for instance, from an OR gate, to which the output signals of the individual keys are fed.

Among the output signals from the performance keys, a signal representing the way of operation of a key, e.g., the speed or force of key depression, is detected by the touch data detecting circuit 3. In response to this signal, the touch data detecting circuit 3 generates touch data. As an example, a first switch may be provided to be responsible to the nondepressed position of each key, and a second switch may be provided to be responsible to the depressed position of the key. With this arrangement, a clock signal may be counted by a counter for a period from the instant of driving of the first switch till the instant of driving of the second switch. The count content of the counter in this case is inversely proportional to the speed of depression of the associated play key, so that it can be used as the touch data. Alternatively, a capacitor may be used such that its discharging is started when the first switch is driven and ended when the second switch is driven. In this case, the voltage remaining across the capacitor may be used as the touch data. The touch data that is formed in the above way is fed from the detecting circuit 3 to the first envelope generating circuit 5.

The output of a timbre switch in a switch unit 7 which is provided in the vicinity of the keyboard 1, is fed to the waveform generating circuit 4 and the first and second envelope generating circuits 5 and 6. The envelope generating circuits 5 and 6 generate different envelope data corresponding to the timbre designated by the timbre switch, these envelope data being fed to a selector 8. These circuits 5 and 6 are driven in response to the key-on signal from the key data detecting circuit 2 to generate the envelope data.

The waveform generating circuit 4 comprises of, for instance, a waveform ROM. When key data is supplied from the key data detecting circuit 2, the waveform ROM is accessed by the data, whereby tone waveform data at a pitch, i.e., frequency, corresponding to the operated key is generated from the waveform generating circuit 4. The tone waveform data thus obtained is fed to one input terminal of a multiplier unit 9. The waveform generating circuit 4 further provides a select signal which controls the select function of the selector 8. That is, the selector 8 selectively feeds the output waveform data of the first and second envelope generating circuits 5 and 6 to the other input terminal of the multiplier unit 9 according to the select signal from the waveform generating circuit 4.

The select signal is, for instance, a binary signal of either "1" or "0" level. This signal of either "0" or "1" is fed as the select signal to the selector 8. The selector 8 selects, for instance, the output of the second envelope generating circuit 6 when the select signal is "1".

The multiplier unit 9 multiplies the output data of the waveform generating circuit 4 by the output data of the selector 8. The product data is fed as tone data to a D/A (digital-to-analog) converter 10 for conversion to analog data which is fed to a timbre forming circuit 11. The timbre forming circuit 11 consists of a filter or the like and forms timbre data corresponding to the analog tone data input. The timbre data thus formed is fed to a sounding circuit 12 including an amplifier and a loudspeaker to be sounded as musical tone.

Figure 2:
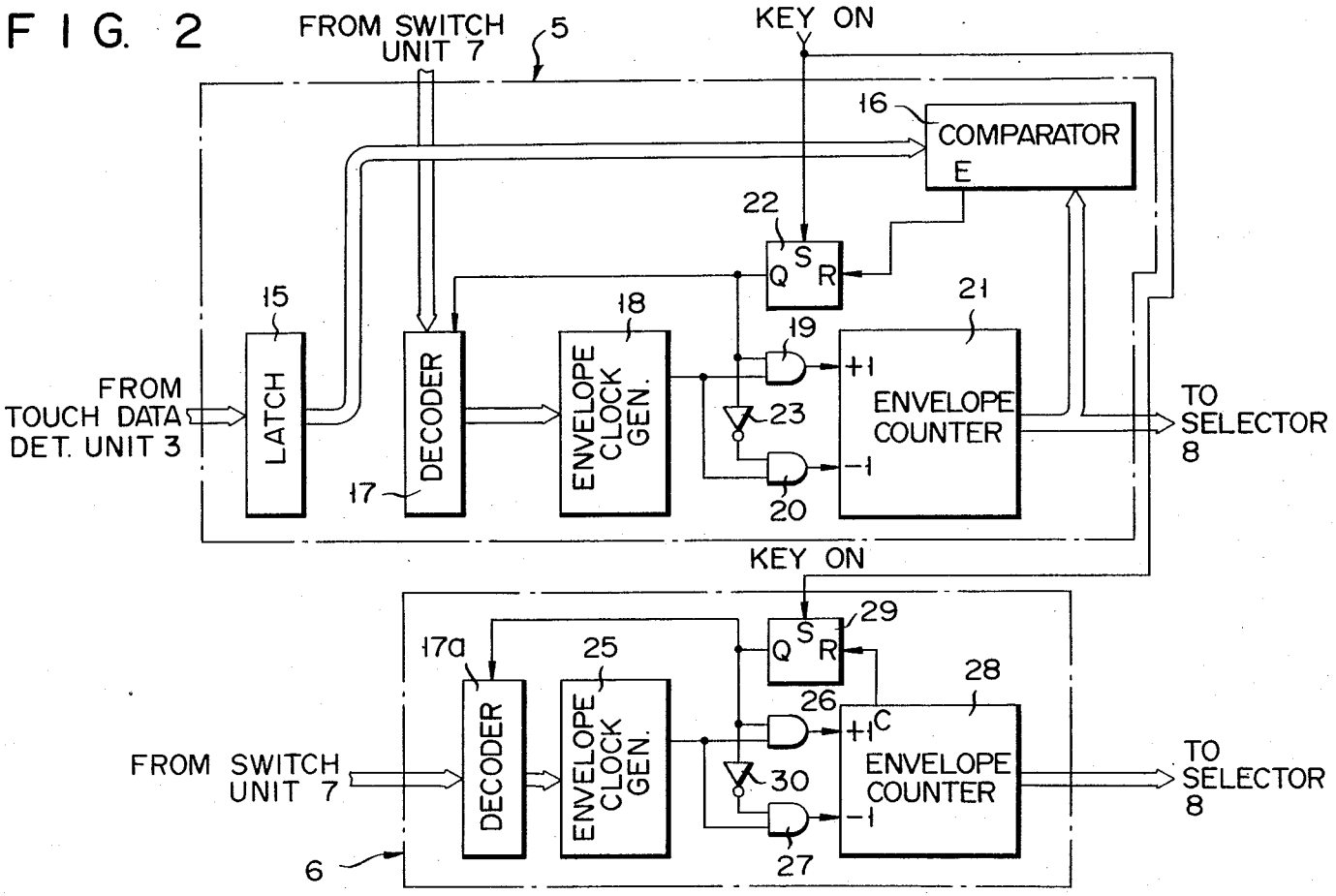
FIG. 2 is a schematic representation of first and second envelope generating circuits shown in FIG. 1.

FIG. 2 shows the specific circuit construction of the first and second envelope generating circuits 5 and 6. The first envelope generating circuit 5 includes a latch 15, in which the touch data from the touch data detecting circuit 3 is latched. The latched touch data is fed to one input terminal of a comparator 16. The output of the timbre switch in the switch unit 7 is fed to a decoder 17. A set output from set output terminal Q of an S-R flip-flop 22 to be described later, is fed to the decoder 17. The decoder 17 decodes the timbre switch output to obtain a value representing the corresponding timbre, which is fed to an envelope clock generator 18. The envelope clock generator 18 generates an envelope clock at a frequency corresponding to the timbre value input. The envelope clock thus generated is fed through an AND gate 19 to an up-count (+1) input terminal of an envelope counter 21, or it is fed through an AND gate 20 to a down-count (−1) input terminal of the counter 21. The envelope clock is up-counted when it is fed to the up-count input terminal of the envelope counter 21, while it is down-counted when it is fed to the down-count input terminal. The count of the envelope counter 21 constitues the envelope waveform data which is fed to the other input terminal of the comparator 16 and also to the selector 8. The comparator 16 compares the output of the latch 15 and the envelope data output of the envelope counter 21. When the two inputs being compared coincide, the comparator 16 generates a signal E, which is fed to the reset input terminal R of S-R flip-flop 22 to reset it. The flip-flop 22 is set when the key-on signal provided in response to the operation of a key is fed to its set input terminal S. Its set output signal provided from its set output terminal Q is fed to the decoder 17. The set output signal is further fed to the AND gate 19 directly and also fed to the AND gate 20 through an inverter 23 to gate control these AND gates 19 and 20.

In the second envelope generating circuit 6, the timbre switch output of the switch unit 7 is fed through the decoder **17*a* to an envelope clock generator 25. A set output signal of a flip-flop 29 to be described later is fed to the decoder 17*a*. The envelope clock generator 25 receives an output of the decoder 17*a* and generates an envelope clock at a frequency corresponding to the designated timbre. The envelope clock is fed through an AND gate 26 to the up-count (+1) input terminal of an envelope counter 28 for up-counting, or it is fed through an AND gate 27 to the down-count (−1) input terminal of the counter for down-counting. The count of the envelope counter 28 is fed as envelope data to the selector 8. When a carry is generated from the counter 28, the envelope counter 28 generates a signal C fed to the reset input terminal R of the S-R flipflop 29 to reset it. The flip-flop 29 is set when the key-on signal provided in response to the operation of a key is fed to its set input terminal S. The set output signal provided from the set output terminal Q of the flip-flop 29 is fed to the AND gate 26 directly and also fed to the AND gate 27 through an inverter 30 for the gate control of these AND gates 26 and 27**.

Figure 3:
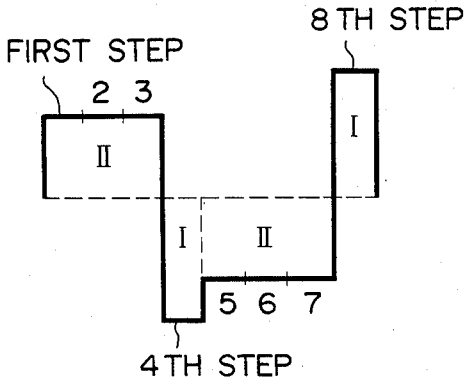
FIG. 3 is a waveform diagram showing an output waveform of a waveform generating circuit.
Figure 4A:
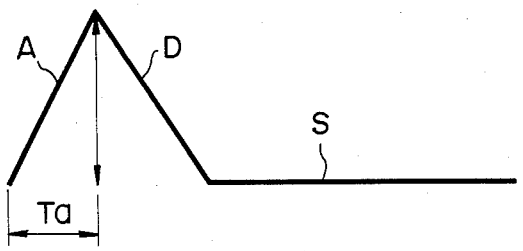
FIGS. 4A and 4B are views showing different envelope waveforms.
Figure 4B:
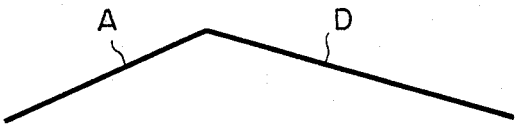

The operation of the first embodiment having the above construction will now be described. It is assumed that the waveform generating circuit 4 generates a waveform as shown in FIG. 3 since a corresponding timbre switch in the switch unit 7 is selected. The waveform illustrated consists of a total of eight steps. The amplitude level of the waveform is positive in the 1st, 2nd and 3rd steps, negative in the 4th, 5th, 6th and 7th steps and positive in the 8th step. Portions of the waveform labeled II, which are constituted by the 1st to 3rd steps and 5th to 7th steps, are modified according to the envelope waveform output of the second envelope generating circuit 6 as designated by the timbre switch output of the switch unit 7 as shown in FIG. 4B. Portions of the waveform labeled I, which are constituted by the 4th and 8th steps, are modified by the envelope waveform output of the first envelope generating circuit 5 as shown in FIG. 4A. In the envelope waveform shown in FIG. 4A, provided from the first envelope generating circuit 5, the length of the attack section A (i.e., attack time Ta) varies in proportion to the data of the touch data detecting circuit 3, e.g., remaining voltage across a capacitor, while the slope of the attack section is fixed. On the other hand, the envelope waveform shown in FIG. 4B, provided from the second envelope generating circuit 6, is fixed.

When a performance key on the keyboard 1 is turned "on", the output signal therefrom is fed to the key data detecting circuit 2 and touch data detecting circuit 3. The key data detecting circuit 2 provides key data representing the pitch of the operated key, which is fed to the waveform generating circuit 4. Simultaneously, the key data detecting circuit 2 feeds the key-on signal as a one-shot pulse to the first and second envelope generating circuits 5 and 6, whereby the envelope generating circuits 5 and 6 are simultaneously driven to start generation of the respective envelope waveforms shown in FIGS. 4A and 4B. The first envelope generating circuit 5 receives the touch data provided from the touch data detecting cirucit 3. The touch data is proportional to the way or speed of key operation, i.e., the magnitude of the touch response. The first envelope generating circuit 5 thus generates an envelope waveform, the attack time Ta of which varies in proportion to the speed of key operation, i.e., the remaining voltage across the capacitor in this case, as mentioned earlier. The envelope waveform data of the first and second envelope generating circuits 5 and 6 are selectively fed by the selector 8 to the multiplier unit 9 according to the content of the select signal provided from the waveform generating circuit 4. The select signal is at level "1" during the 1st to 3rd steps and 5th to 7th steps of the tone waveform output of the waveform generating circuit 4 shown in FIG. 3. During this time, the envelope waveform output of the second envelope generating circuit 6 is selected. During the 4th and 8th steps of the tone waveform shown in FIG. 3, the select signal is at level "0". During this time, the envelope waveform output of the first envelope generating circuit 5 is selected. When the waveform generating circuit 4 is providing the waveform data for the 1st to 3rd steps and 5th to 7th steps of the waveform of FIG. 3, the multiplier unit 9 multiplies this waveform data by the envelope data shown in FIG. 4B and feeds the result data to the D/A converter 10. On the other hand, when the waveform data for the 4th and 8th steps of the waveform of FIG. 3 is being provided, the multiplier unit 9 multiplies this waveform data by the envelope data shown in FIG. 4A and feeds the result data to the D/A converter 10. In other words, the D/A converter 10 receives a tone signal, which is obtained under control by different envelope waveforms for different portions of the waveform shown in FIG. 3, the tone signal being converted to analog data. The analog tone data thus obtained is fed to the timbre forming circuit 11 to form timbre data which is fed to the sounding circuit 12 for sounding as musical tone.

The operation of the first and second envelope generating circuits 5 and 6 will now be described in greater detail with reference to FIG. 2. When a key is operated, the corresponding touch data is provided and latched in the latch 15 in the first envelope generating circuit 5 to be fed to one terminal of the comparator 16. Simultaneosly, the key-on signal is provided as "1" signal to set the flip-flops 22 and 29. The flip-flop set outputs of "1" enable the AND gate 19, disable the AND gate 20, enable the AND gate 26 and disable the AND gate 27.

The decoder 17 receives the timbre switch output from the switch unit 7 and the flip-flop set output of "1", so that it feeds an output corresponding to the envelope waveform shown in FIG. 4A to the envelope clock generator 18. The envelope clock generator 18 thus starts to provide the envelope clock at the frequency corresponding to the designated timbre. The envelope clock is fed through the AND gate 19 to the up-count input terminal of the envelope counter 21 to be up-counted.

The envelope clock generator 25 in the second envelope generating circuit 6 receives the timbre switch output of the switch unit 7 via the decoder 17*a*, so that it provides the envelope clock corresponding to the fixed envelope waveform shown in FIG. 4B. This envelope clock is fed through the AND gate 26 to the up-count input terminal of the envelope counter 28 to be up-counted.

In the envelope counter 21, the up-counting is continued until the end of the attack time Ta. During this time, the count contents, i.e., envelope waveform data, is fed to the selector 8, and it is also fed to the comparator 16 for comparison with the touch data from the latch 15. When the count contents coincide with the touch data, the comparator 16 provides a signal E of "1" to reset the flip-flop 22. As a result, the AND gate 19 is disabled while the AND gate 20 is enabled, causing the envelope clock to be fed through the AND gate 20 to the down-count input terminal of the envelope counter 21 for down-counting. The envelope clock at this time has the same frequency as that during the preceding attack time. The appearance of the signal E of "1" brings an end to the attack time Ta of the envelope waveform shown in FIG. 4A so that the decay state D sets in. The attack time Ta is proportional to the magnitude of the touch data, i.e., the remaininig voltage across the capacitor in this case. It will be understood that the attack time Ta is long when the key operation is quick, and is short when the key operation is slow. After the end of the attack time Ta, the down-counting is started to progressively reduce the count contents, so that the amplitude of the envelope waveform approaches zero. After the reaching of the zero amplitude, this value is held in the sustain state S as shown in FIG. 4A.

In the envelope counter 28, on the other hand, upon reaching to a predetermined value of the envelope waveform shown in FIG. 4B, a carry signal C of "1" is provided to reset the flip-flop 29. As a result, the AND gate 26 is disabled while the AND gate 27 is enabled, causing the envelope clock to be fed through the AND gate 27 to the down-count input terminal of the envelope counter 28 for down-counting. The count contents are thus progressively reduced to reduce the amplitude of the envelope waveform. The frequency of the envelope clock fed to the down-count input terminal is the same as that fed to the up-count input terminal.

Figure 5:
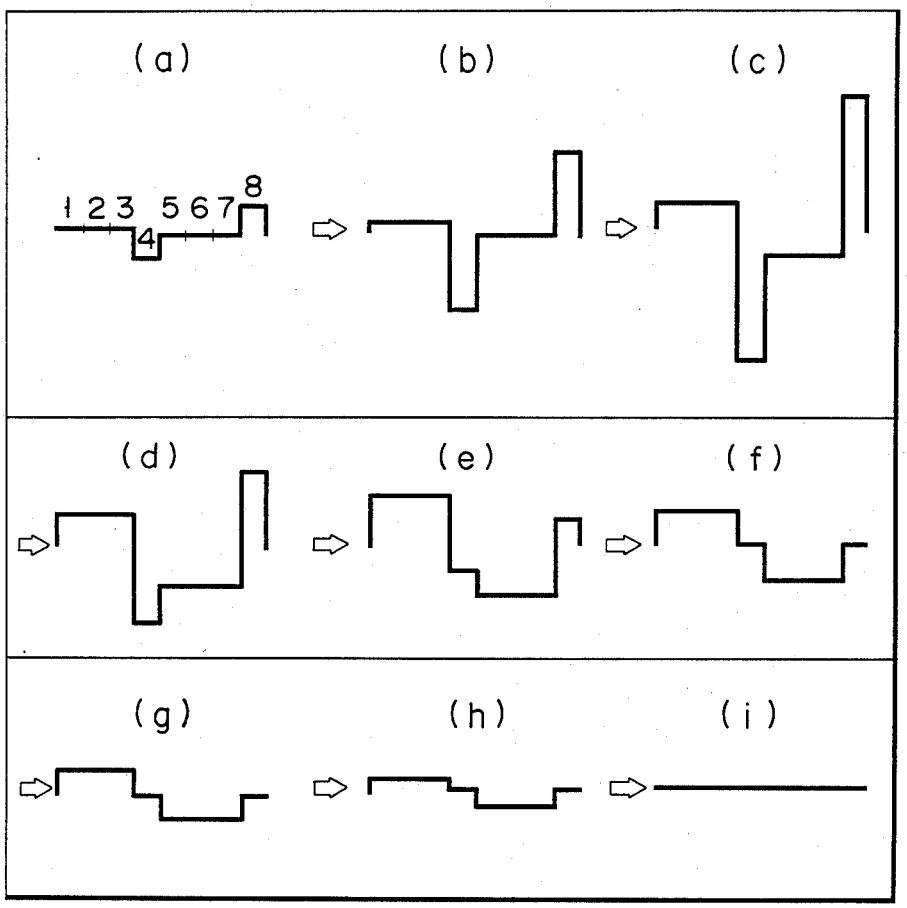
FIGS. 5 to 7 are views showing different variations of tone waveform with the way of operation of a performance key in case where the waveform of FIG. 3 is modified with the envelope waveforms of FIGS. 4A and 4B.
Figure 6:
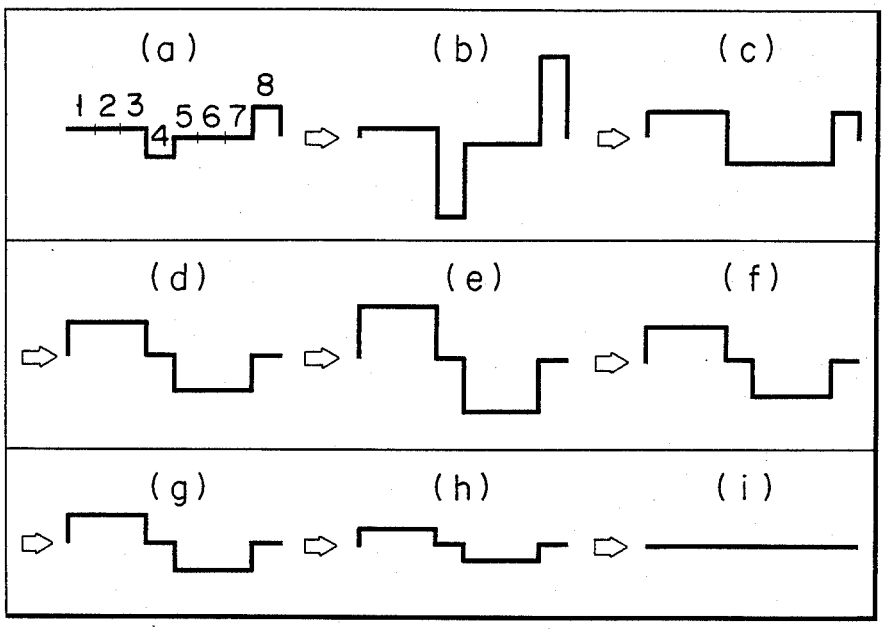
Figure 7:
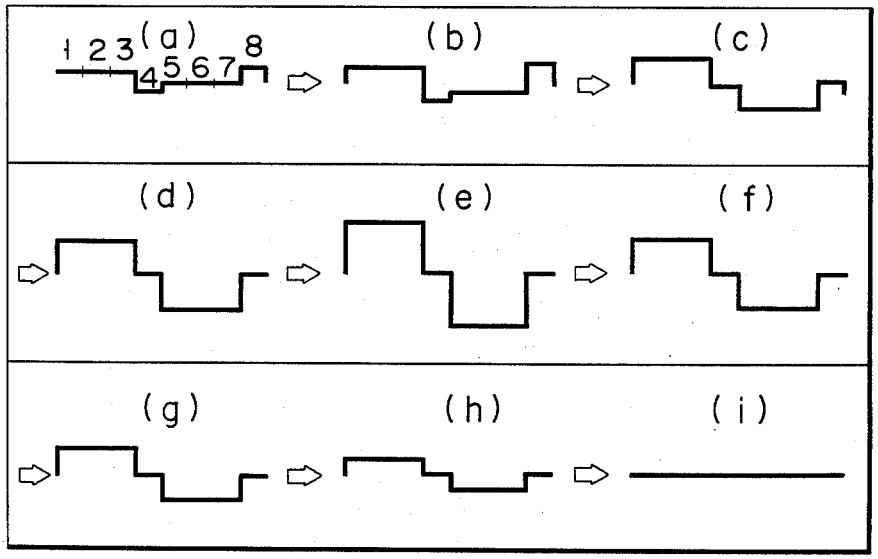

FIGS. 5 to 7 illustrate the way how the waveform of FIG. 3 is controlled according to the envelope waveforms of FIGS. 4A and 4B in respective cases where a large touch data is provided in response to strong or quick depression of a key, where a medium touch data is provided in response to moderate depression of the key and where a small touch data is provided in response to weak or slow depression of the key. In these Figures, the volume level is shown in nine stages (a) to (i) during the period from the key-on until it becomes zero after the key-off. It will be obvious from the Figure that when the key is depressed strongly in the case of FIG. 5, the attack time Ta of the envelope waveform of FIG. 4A is long, and for the 4th and 8th steps of the waveform of FIG. 3 modified with the envelope waveform it takes a long time until there occurs the third stage (c). Besides, the level is far higher than those in the cases of FIGS. 6 and 7. When the key is depressed moderately or weakly as in the case of FIGS. 6 or 7, the attack time Ta is shorter, and the modification with the envelope waveform of FIG. 4A is quicker and less. It is to be appreciated that in either of the cases of FIGS. 5 to 7, that both the volume and timre of the generated tone are varied according to the touch response.

Figure 8:
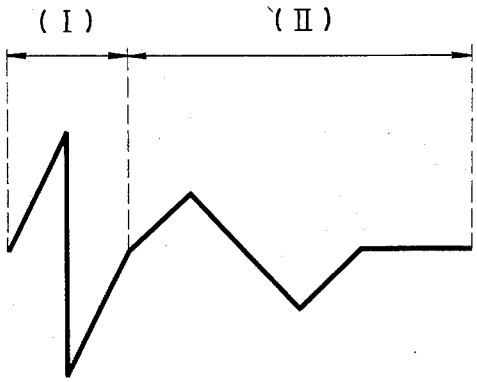
FIG. 8 is a view showing a different waveform.
Figure 9A:
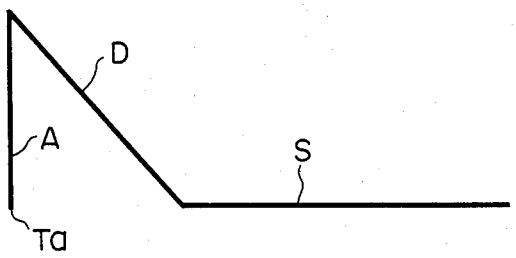
FIGS. 9A and 9B are views showing other envelope waveforms.
Figure 9B:
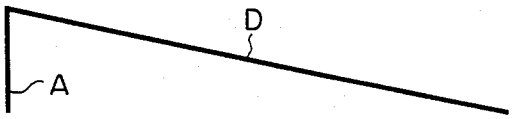
Figure 10:
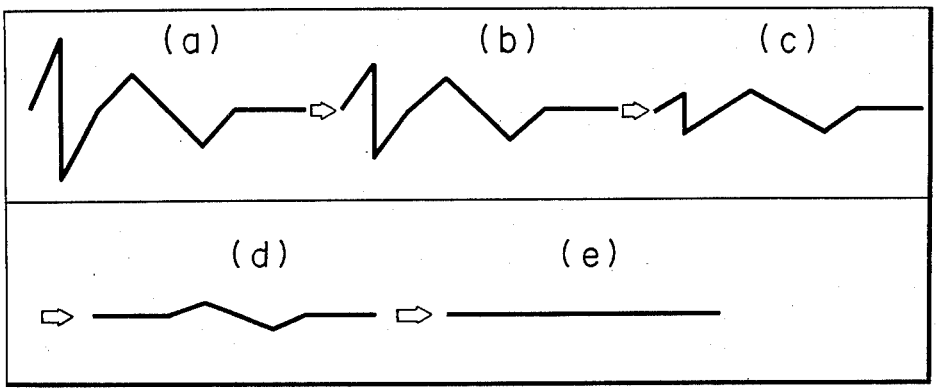
FIGS. 10 to 12 are views showing different variations of tone waveform when a key is depressed weakly, moderately and strongly, respectively, in case where the waveform of FIG. 8 is modified with the envelope waveforms of FIGS. 9A and 9B.
Figure 11:
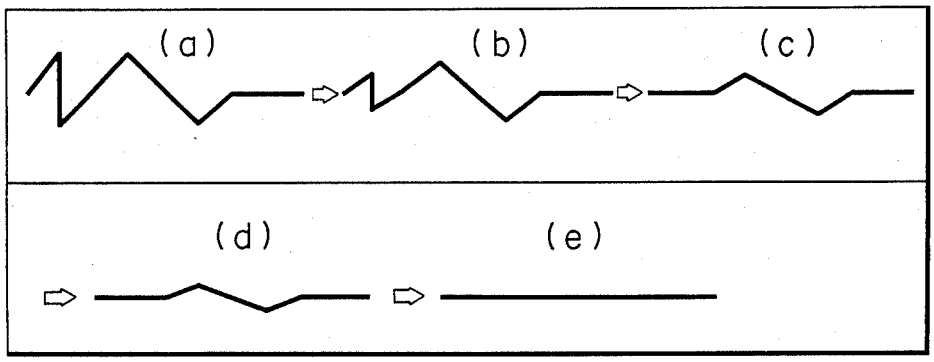
Figure 12:
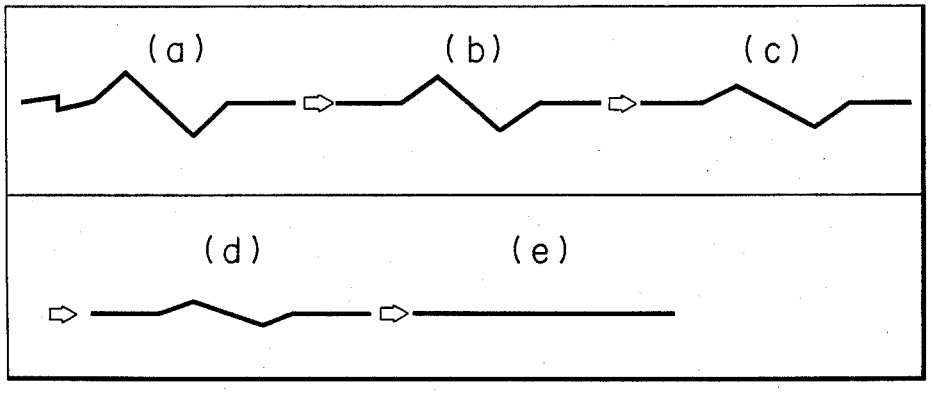

FIGS. 10 to 12 show how the volume and timbre are varied in case where the waveform generating circuit 4 of FIG. 1 generates a waveform shown in FIG. 8 instead of the waveform of FIG. 3. In FIG. 8, a first portion of the waveform (labelled I) is modified according to an envelope waveform shown in FIG. 9A, the attack section A of which is variable according to the touch data, and a second portion of the waveform (labelled II) is modified according to a fixed envelope waveform independent of the touch data as shown in FIG. 9B.

Switching of timbre switches in the switch unit 7 makes it possible that the waveform generating circuit 4 generates the waveform of FIG. 8, the envelope counter 21 generates the envelope waveform of FIG. 9A and the envelope counter 28 generates the envelope waveform of FIG. 9B. In this case, the envelope clock generator 18 generates an envelope clock at a high frequency, so that the generated envelope waveform as the variable envelope waveform of FIG. 9A is such that the attack time Ta is substantially independent of the touch response and substantially zero although the attack section level A is variable according to the touch response.

When a key is operated so that the flip-flops 22 and 29 are both set by the key-on signal of "1" provided in response to the depression of the key, the envelope counter 21 starts up-counting of the high frequency envelope clock to generate the envelope waveform of FIG. 9A. The speed of the up-counting is proportional to the magnitude of the touch data latched in the latch 15, and it is the higher the larger is the touch data. When the attack section A is ended, the comparator 16 generates a signal E of "1" to reset the flip-flop 21, thus causing the envelope counter 21 to start down-counting. The frequency of the envelope clock provided during the down-counting is substantially low compared to the frequency during the up-counting for the set signal from the flip-flop 22 is "0". Thus, the level in the decay section D decreases slowly as shown in FIG. 9A. When the count contents reach "0", this value is held subsequently.

In the other envelope counter 28, the frequency of the envelope clock during the up-counting corresponding to the attack section A, is also high compared to the case of FIG. 4B. When the up-counting is ended, the envelope counter 28 generates a carry signal C of "1" to reset the flip-flop 29, thus causing the envelope counter 21 to start down-counting. The speed of down-counting is substantially low compared to the up-counting speed since the set output of the flip-flop 29 is "0". The count contents are gradually reduced till the key-off, and in the subsequent decay section D the level is reduced gradually, as shown in FIG. 9B.

FIGS. 10 to 12 illustrate variations of the volume and timbre of the generated tone with the envelope waveforms of FIGS. 9A and 9B provided for the modification of the waveform of FIG. 8 when a key is depressed strongly, moderately and weakly, respectively. As is obvious from the Figures, again in this case both the volume and timbre of the generated tone are varied according to the touch response.

A second embodiment of the invention will now be described with reference to FIGS. 13 through 25. Parts like those in the preceding first embodiment are designated by like reference numerals. This embodiment is different from the first embodiment in that while in the first embodiment only one of the two different envelope waveforms is variable in proportion to the touch response, in this instance two different envelope waveforms are both variable. More specifically, two data transforming units are provided for transforming common touch data to respective different data.

Figure 13:
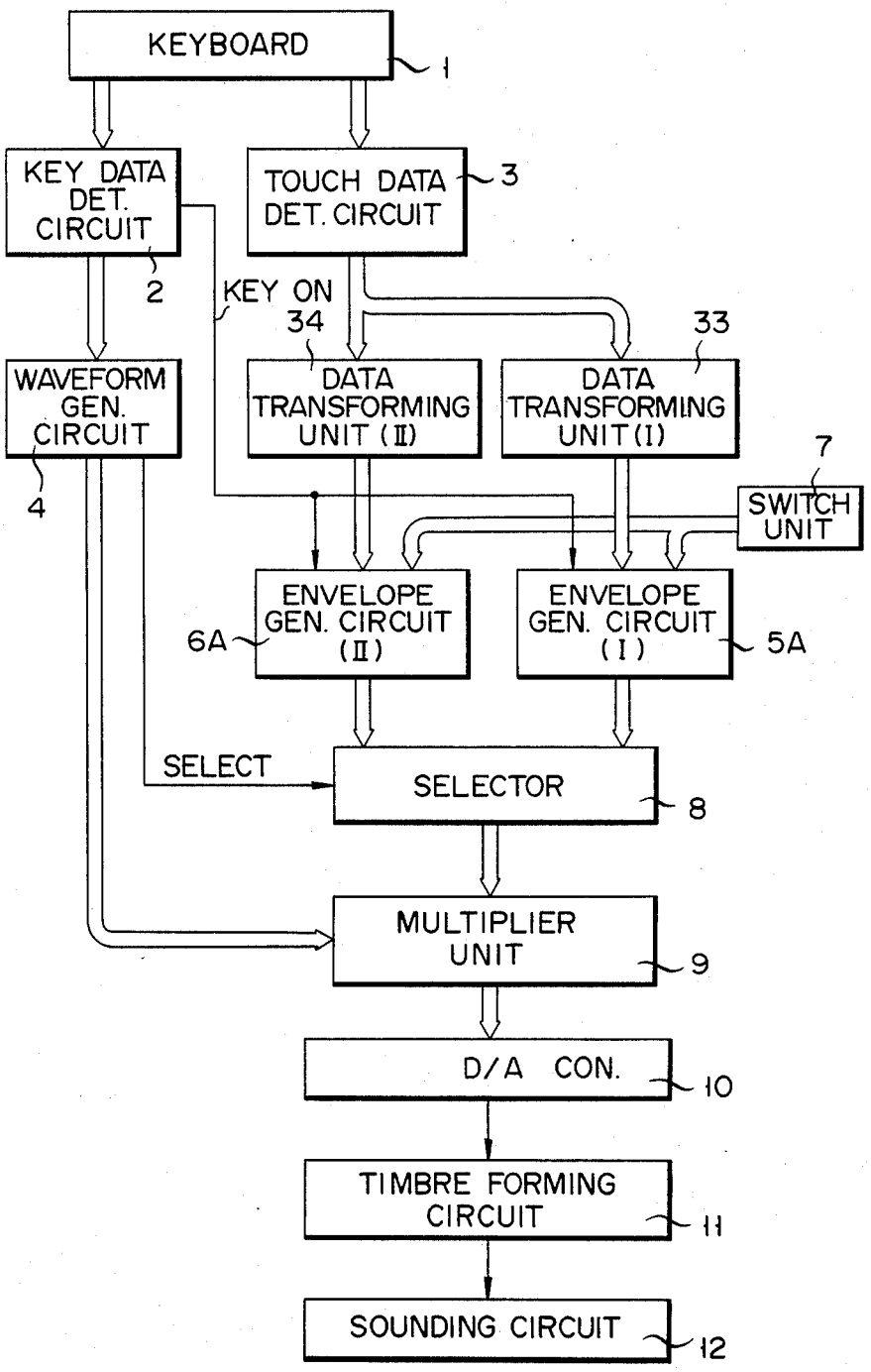
Figure 15:
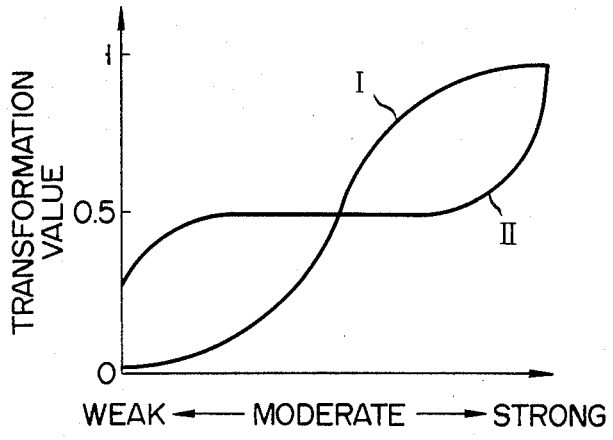

Referring to FIG. 13, touch data provided from touch data detecting circuit 3 is fed to first and second data transforming units 33 and 34. The first and second data transforming units 33 and 34 have preset transformation characteristics as shown in FIG. 15.

In the transformation characteristic of the first data transforming unit 33, the value of transformation increases according to the level of the touch data such that it is substantially proportional thereto for regions thereof corresponding to the cases when a key is depressed weakly, a little weakly, moderately, a little strongly and strongly, respectively. In the transformation characteristic of the second data transforming unit 34, on the other hand, the magnitude of the transformation data increases rather sharply in a region of the touch data somewhere between the regions corresponding to the weak and a little weak key depression. In the touch data regions corresponding to depression of the key a little weakly, moderately and a little strongly, the transformation value is fixed and equal to the value of the first data transforming unit 33 in the moderate key depression region (which corresponds to the intersection between the curves I and II). In a touch data region somewhere between the regions corresponding to the depression of the key a little strongly and strongly, the transformation value again increases rather sharply.

Figure 14:
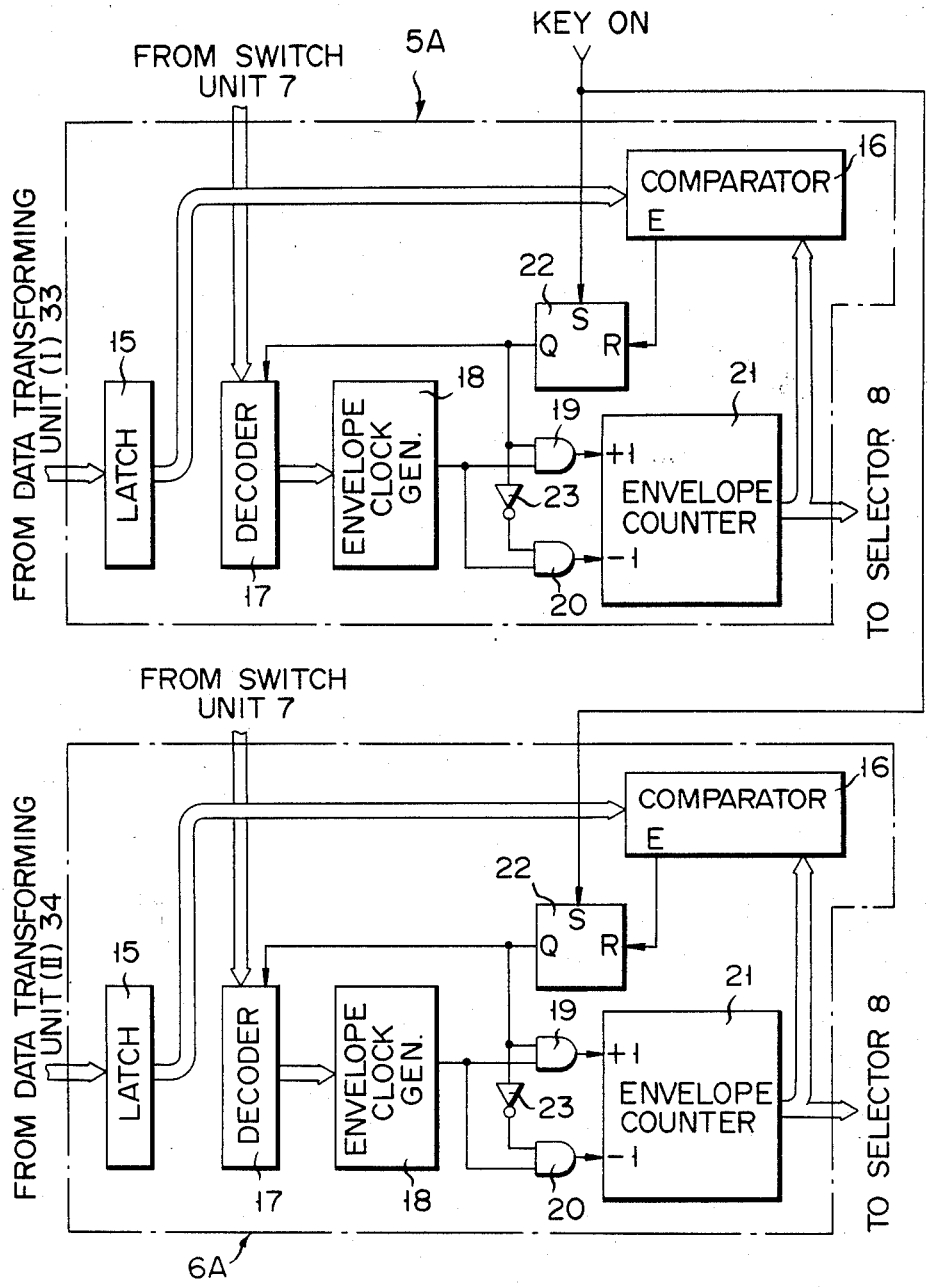

The transformation output of the first data transforming unit 33 is fed to first envelope generating circuit 5A, and the transformation output of the second data transforming unit 34 is fed to second envelope generating circuit 6A. FIG. 14 shows the circuit construction of the envelope generating circuits 5A and 6A. As is seen, the construction is entirely the same as the first envelope generating circuit 5 in the first embodiment.

With the second embodiment, the volume and timbre of the generated tone are varied in the manner to be described. The description will be made in conjunction with a case, in which the waveform generating circuit 4 generates the waveform of FIG. 3 described before in connection with the first embodiment and the first and second data transforming units 33 and 34 transform the respective envelope waveforms of FIGS. 4A and 4B provided from the first and second envelope generating circuits 5A and 6A as variable data to transformation data.

When the touch data detecting circuit 3 provides maximum touch data in response to strong depression of a key, the first and second data transforming units 33 and 34 both provide maximum transformation data.

Figure 16:
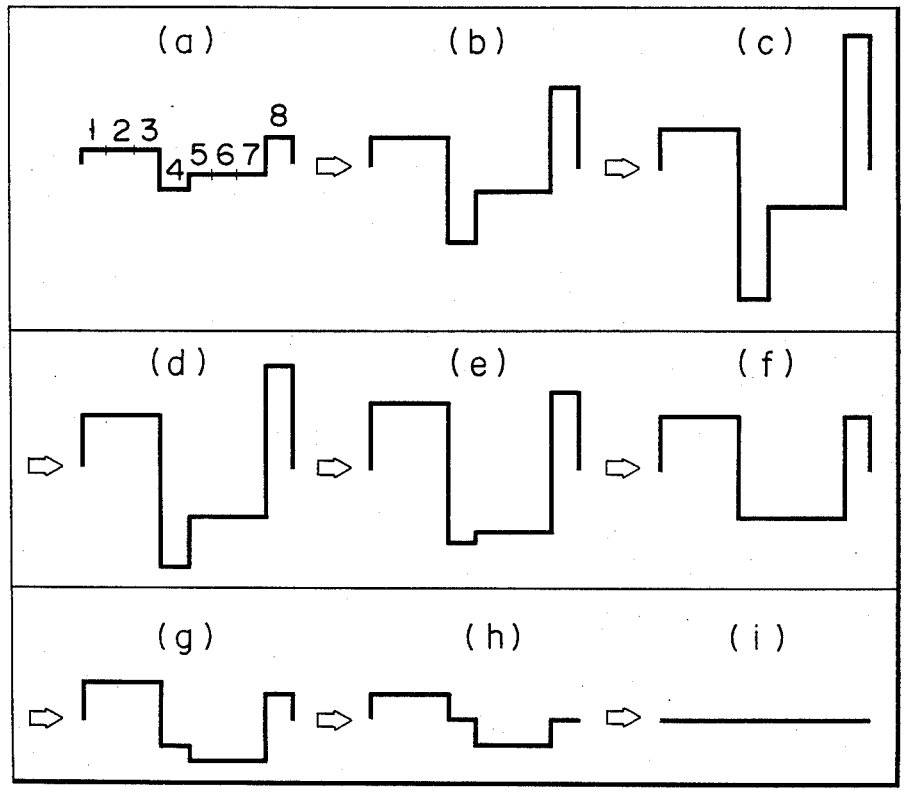

These transformation data are substantially equal, or the transformation data from the first data transforming unit 33 is slightly greater, as is seen from FIG. 15. FIG. 16 shows the variation of the tone waveform in this case. This variation results from the control of the waveform of FIG. 3 according to the envelope waveform of FIG. 4A for the 1st to 3rd and 5th to 7th steps and according to the envelope waveform of FIG. 4B for the 4th and 8th steps.

With the maximum transformation data noted above fed to it, the first envelope generating circuit 5A provides an envelope waveform as shown in FIG. 4A, in which the attack level, i.e., attack time, is maximum, by the operation as described before. Likewise, the second envelope generating circuit 6A generates an envelope waveform as shown in FIG. 4B, in which the attack level is maximum. Thus, the tone waveform which is obtained as a result of the modification of the waveform of FIG. 3 with the envelope waveform of FIG. 4A has a maximum level for the 4th and 8th steps in the third stage (c) after the key-on, as shown in FIG. 16. For the 1st to 3rd and 5th to 7th steps, the maximum level occurs in the fifth stage (e) after the key-on since the attack section A rises rather slowly. The maximum level in this case is higher than any other case of depressing the key in any other way.

Figure 17:
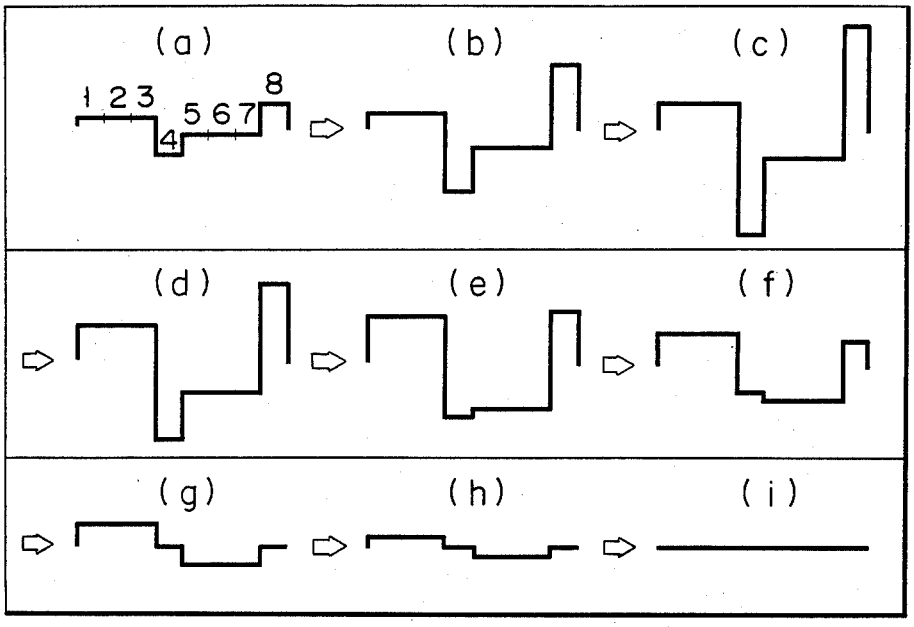

FIG. 17 shows the tone waveform variation in case when the key is depressed a little strongly. In this case, the transformation data obtained from the first data transforming unit 33 is slightly lower than in the case when the key is depressed strongly, as is seen from FIG. 15. The transformation data from the second data transforming unit 34 is about one half the data obtained in the case of the strong key depression. Thus, in this case the maximum level for the 4th and 8th steps takes place in the third stage (c) after the key-on. This value is lower than in the case of FIG. 16. For the 1st to 3rd and 5th to 7th steps, the level is varied in a similar manner to that in the case of FIG. 16, but the maximum level is approximately one half the value in the case of FIG. 16.

Figure 18:
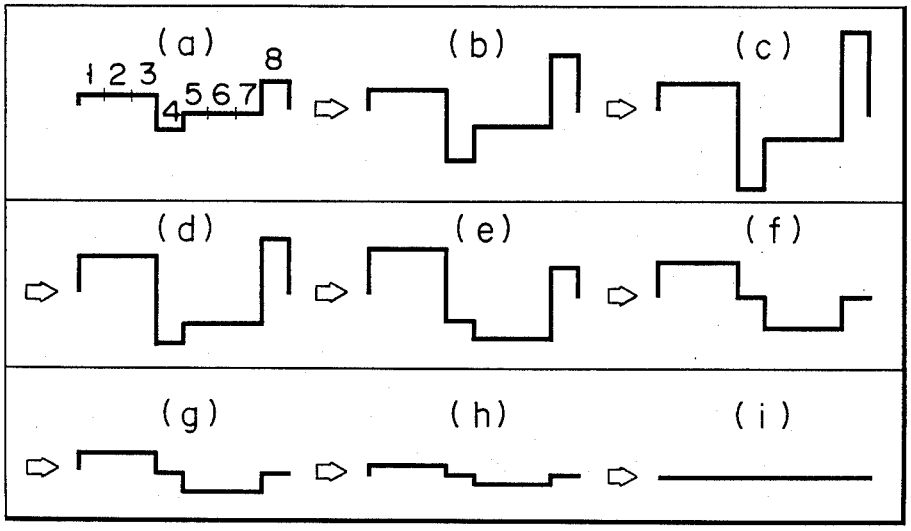

FIG. 18 shows the variation in case when the key is depressed moderately. In this case, the transformation data from the first data transforming unit 33 is substantially one half the maximum level as is seen from FIG. 15, while the transformation data from the second data transforming unit 34 is substantially the same as in the preceding case when the key is depressed a little strongly. Both the transformation data are substantially equal. Thus, the tone waveform level for the 4th and 8th steps is varied substantially in the same manner as in the cases of FIGS. 16 and 17. The maximum level, however, is approximately one half of the value in the case of FIG. 16. For the 1st to 3rd and 5th to 7th steps, the level variation and maximum level are like those in the case of FIG. 17.

Figure 19:
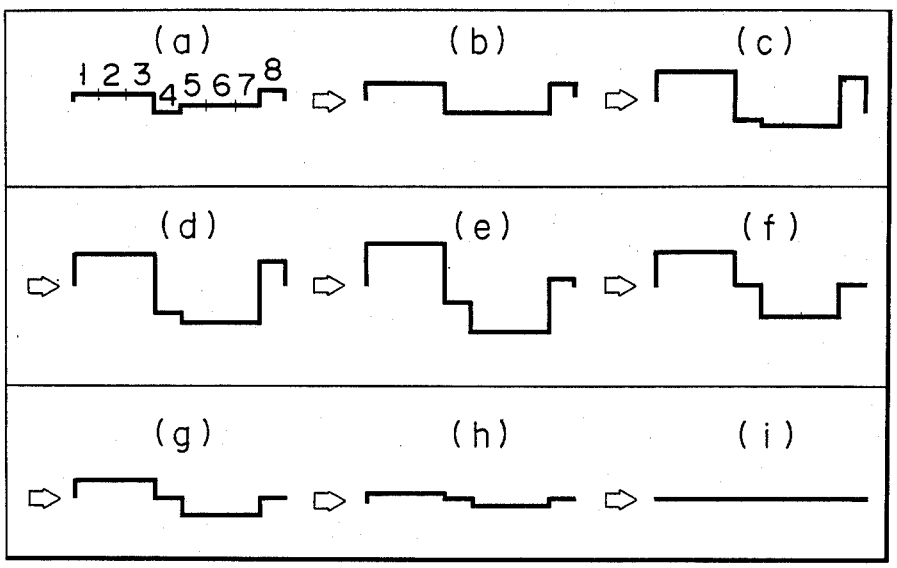

FIG. 19 shows the variation in case when the key is depressed a little weakly. In this case, the transformation data from the first data transforming unit 33 is approximately 10 percent of the maximum level, as is seen from FIG. 15. The transformation data from the second data transforming unit 34 is approximately one half the maximum level. The level is thus varied substantially in the same manner as in the cases of FIGS. 17 and 18. More specifically, for the 4th and 8th steps the maximum level occurs in the fourth stage (d) after the key-on. The maximum level in this case is further low. For the 1st to 3rd and 5th to 7th steps, the level is varied substantially in the same manner as in the cases of FIGS. 17 and 18.

Figure 20:
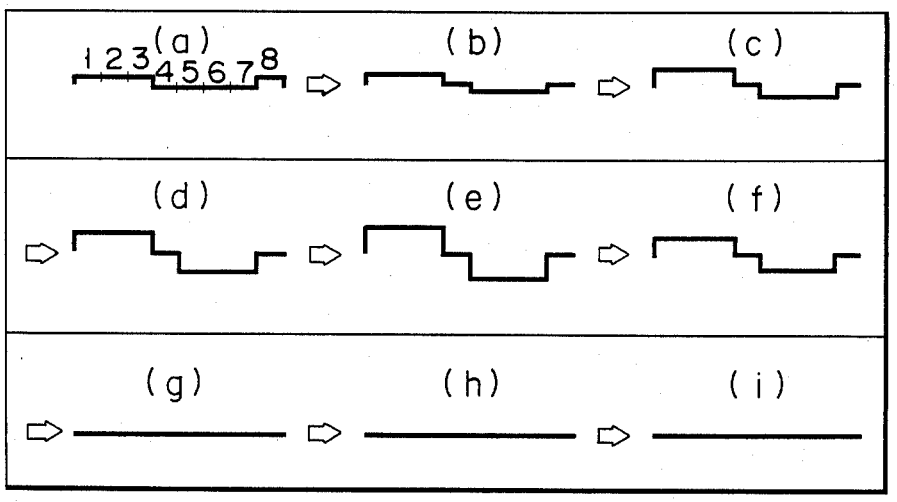
Figure 21:
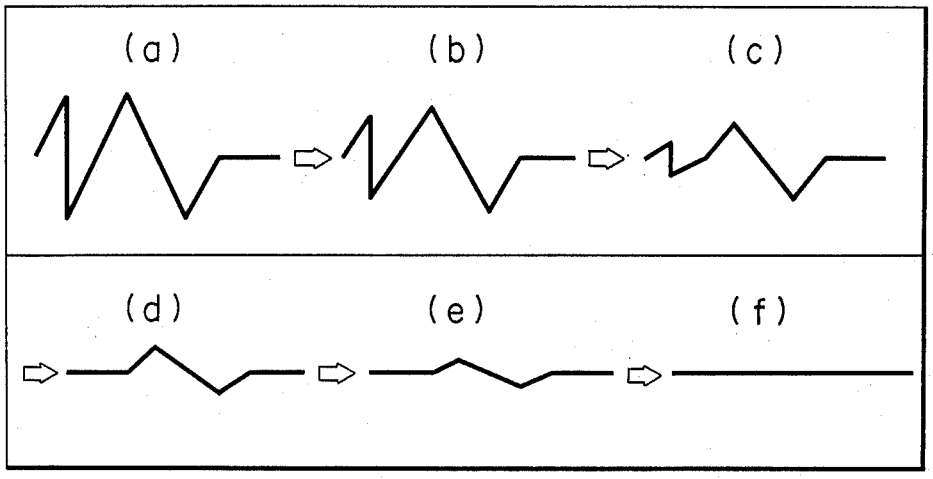
Figure 22:
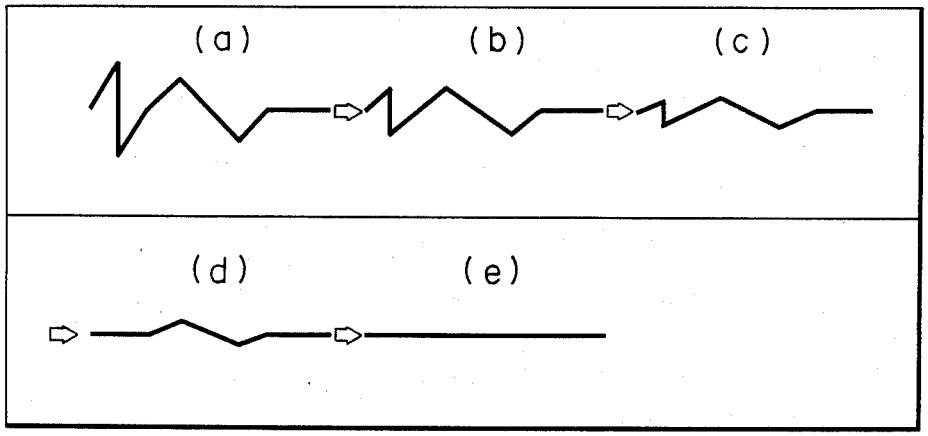
Figure 23:
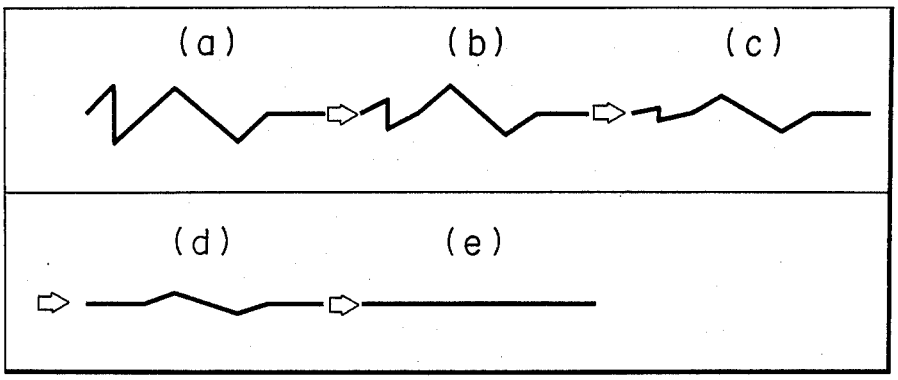
Figure 24:
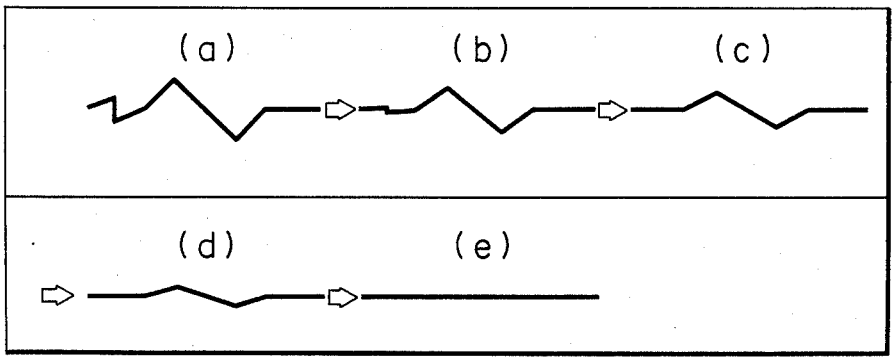
Figure 25:
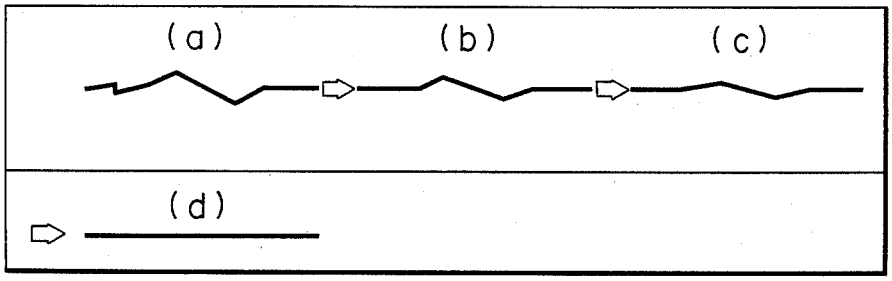

FIG. 20 shows the variation when the key is depressed weakly. In this case, the transformation data from the first data transforming unit 33 is zero, while the transformation data from the second data transforming unit 34 is slightly higher. Thus, for the 4th and 8th steps, the level becomes zero immediately after the key-on. For the 1st to 3rd and 5th to 7th steps, the maximum level is less than and becomes zero more quickly than in the case of FIG. 19.

It will be seen that with the second embodiment the volume and timbre of the tone waveform again are varied according to the touch response.

FIGS. 21 to 25 illustrate different variations of the volume and timbre of tone obtained with the second embodiment in case where the waveform of FIG. 8 described before in connection with the first embodiment is generated from the waveform generating circuit 4 and controlled for the first portion (I) according to the envelope waveform of FIG. 9A provided from the first envelope generating circuit 5A and for the second portion (II) according to the envelope waveform of FIG. 9B provided from the second envelope generating circuit 6A. These Figures respectively concern the cases when a key is depressed strongly, a little strongly, moderately, a little weakly and weakly. The variations are substantially the same as described before, so their detailed desciption is omitted.

A third embodiment will now be described with reference to FIGS. 26 through 30. This embodiment is a sort of modification of the previous first embodiment. In this instance, two waveform generating circuits are provided and alternately generate respective different waveforms. The waveform generated from one of the waveform generaeting circuits is modified according to an envelope waveform which is variable according to the touch response. The waveform from the other waveform generating circuit is modified according to a fixed envelope waveform independent of the touch response. The two modifications of waveforms are combined to obtain a tone.

Figure 26:
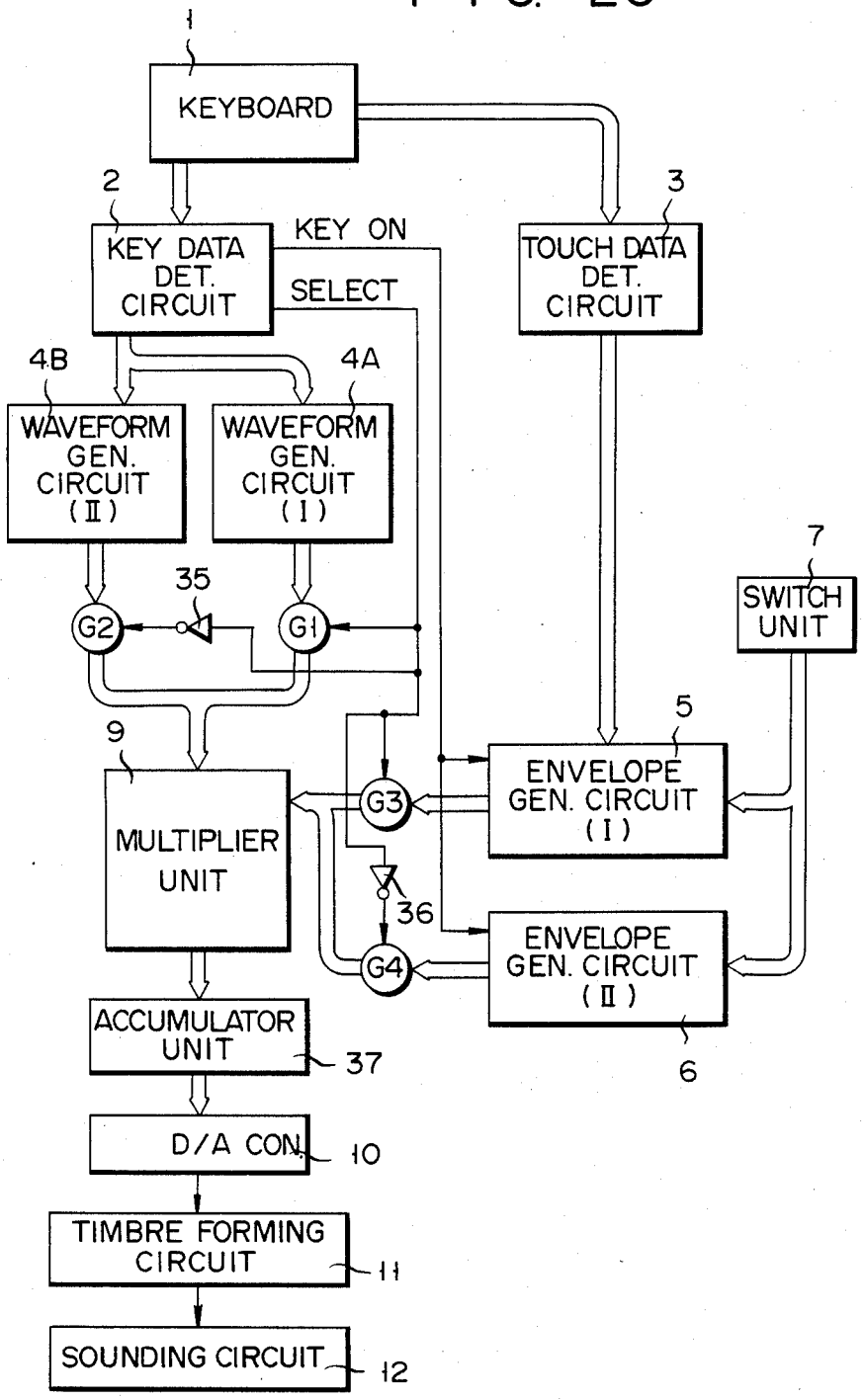

FIG. 26 shows the circuit of the third embodiment. The circuit construction is basically the same as the circuit shown in FIG. 1, and like parts are designated by like reference numerals. Key data detecting circuit 2, which receives data from keyboard 1, feeds key data representing the pitches of operated keys simultaneously to first and second waveform generating circuits 4A and 4B. The circuit 2 also feeds key-on signal to first and second envelope generating circuits 5 and 6. It further provides a select signal, which is fed to gate circuits G1 and G3 directly and also to gate circuits G2 and G4 through respective inverters 35 and 36, whereby these gate circuits are gate controlled.

Figure 27A:
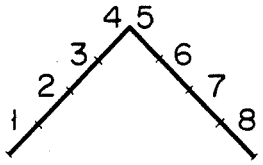
FIGS. 27A and 27B are views showing waveforms generated by first and second waveform generating circuits.
Figure 27B:
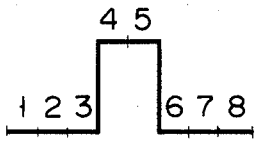

The first waveform generating circuit 4A generates a triangular waveform as shown in FIG. 27A, which is fed thorugh the gate circuit G1 to multiplier unit 9. The second waveform generating circuit 4B generates a pulse-like waveform as shown in FIG. 27B which is fed through the gate circuit G2 to the multiplier unit 9.

The first envelope generating circuit 5 generates an envelope waveform as shown in FIG. 4A, which is variable according to the touch data from the touch data detecting circuit 3. The envelope waveform is fed through the gate circuit G3 to the multiplier 9. The second envelope generating circuit 6 generates a fixed envelope waveform as shown in FIG. 4B, which is fed through the gate circuit G4 to the multiplier unit 9.

The operation of the third embodiment will now be described. When a key is depressed, the key data detecting circuit 2 feeds key data representing the pitch of that key to the waveform generating circuits 4A and 4B. As a result, the waveform generating circuits 4A and 4B start to generate the respective waveforms of FIGS. 27A and 27B which are fed to the gate circuits G1 and G2.

In response to the key operation, the key data detecting circuit 2 also feeds a key-on signal to the envelope generating circuits 5 and 6 to cause these circuits to generate the respective envelope waveforms of FIGS. 4A and 4B. The key data detecting circuit 2 further provides a select signal, which is "1" for the first half of the waveform, i.e., 1st to 4th steps, and "0" for the second half, i.e., 5th to 8th steps. The select signal is fed to the gate circuits G1 to G4 for the gate control thereof. Thus, during the first half of the waveform the gate circuits G1 and G3 are held enabled while the gate circuits G2 and G4 are held disabled. During the second half of the waveform, the gate circuits G2 and G4 are held enabled while the gate circuits G1 and G3 are held disabled. During the first half period, the tone waveform of FIG. 27A from the first waveform generating circuit 4A and the envelope waveform of FIG. 4A from the first envelope generating circuit 5 are fed through the respective gate circuits G1 and G3 to the multiplier unit 9 for multiplication. During the second half period, the tone waveform of FIG. 27B from the second waveform generating circuit 4B and the envelope waveform of FIG. 4B from the second envelope generating circuit 6 are fed through the respective gate circuits G2 and G4 to the multiplier unit 9 for multiplication. The multiplication result data during the first half period and that during the second half period are accumulated in an accumulator unit 37. The output of the accumulator unit 37 is fed through D/A converter 10, timbre forming circuit 11 and sounding circuit 12 for sounding as musical tone.

Figure 28:
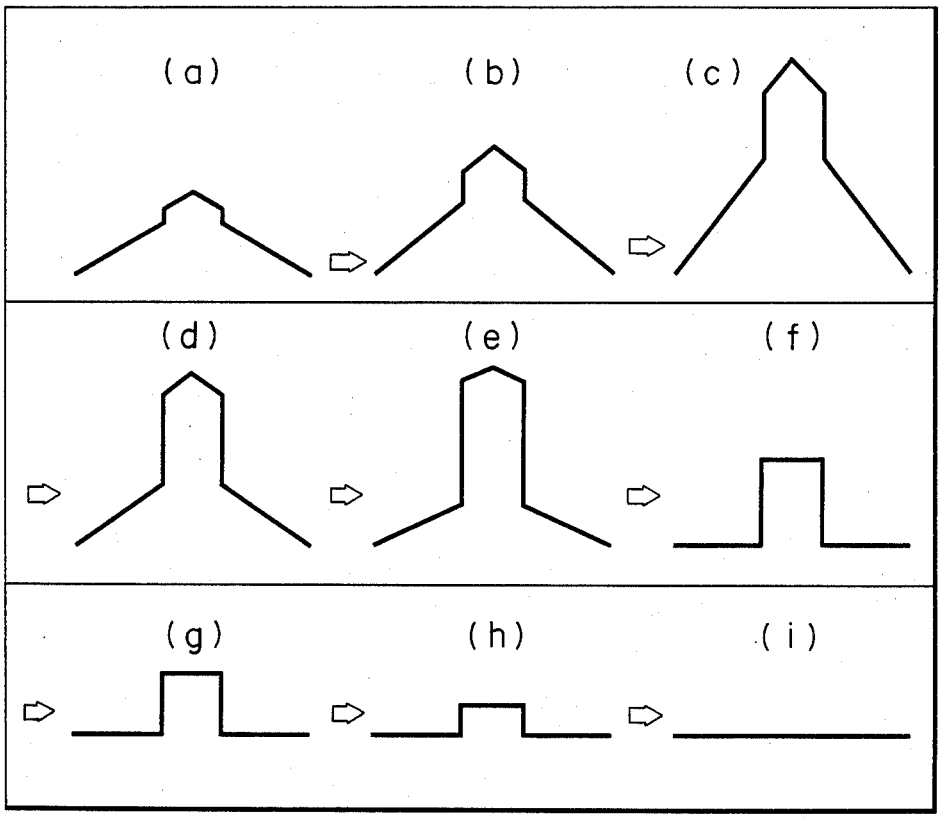
Figure 29:
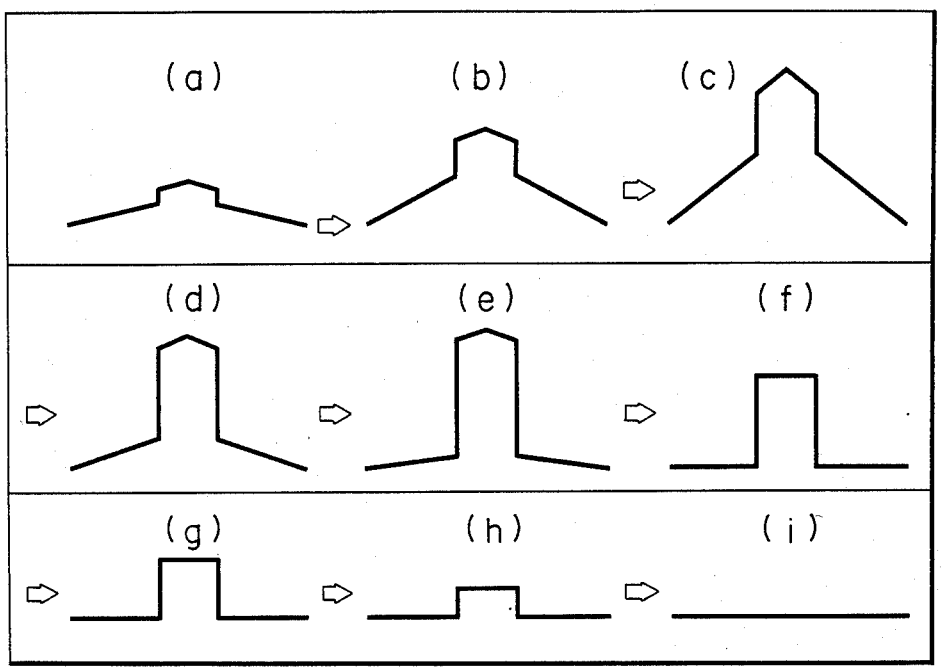
Figure 30:
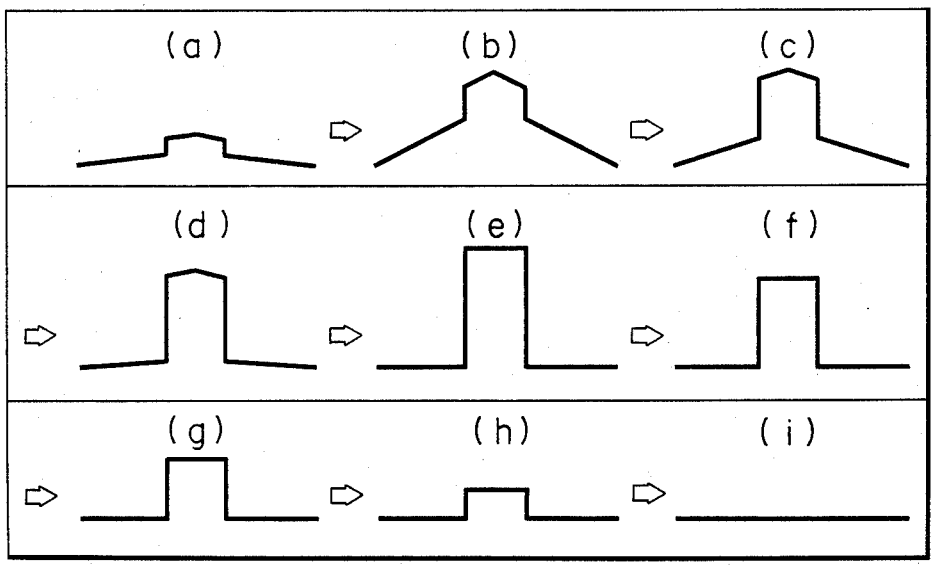

FIGS. 28 to 30 illustrate how the volume and timbre are varied according to the touch response. FIG. 28 shows the variations in case when a large touch data is fed to the first envelope generating circuit 5 in response to strong depression of a key. As is shown, the attack level that is attributable to the triangular tone waveform of FIG. 27A controlled according to the touch data, is high and present substantially up to one half of the tone duration after the key-on. The component due to the pulse-like tone waveform of FIG. 27B which is not controlled according to the touch data, rises slowly and falls slowly according to the envelope waveform of FIG. 4B.

FIG. 29 shows the variations in case when the key is depressed moderately. In this case, the triangular tone waveform component appears to a less extent than in the case of FIG. 28. FIG. 30 shows the variations in case when the key is depressed weakly. In this case, the attack time Ta of the envelope waveform of FIG. 4A is very short, so that the extent of appearance of the triangular tone waveform is further reduced. It will be seen that with the third embodiment again the volume and timbre are both varied.

Figure 31:
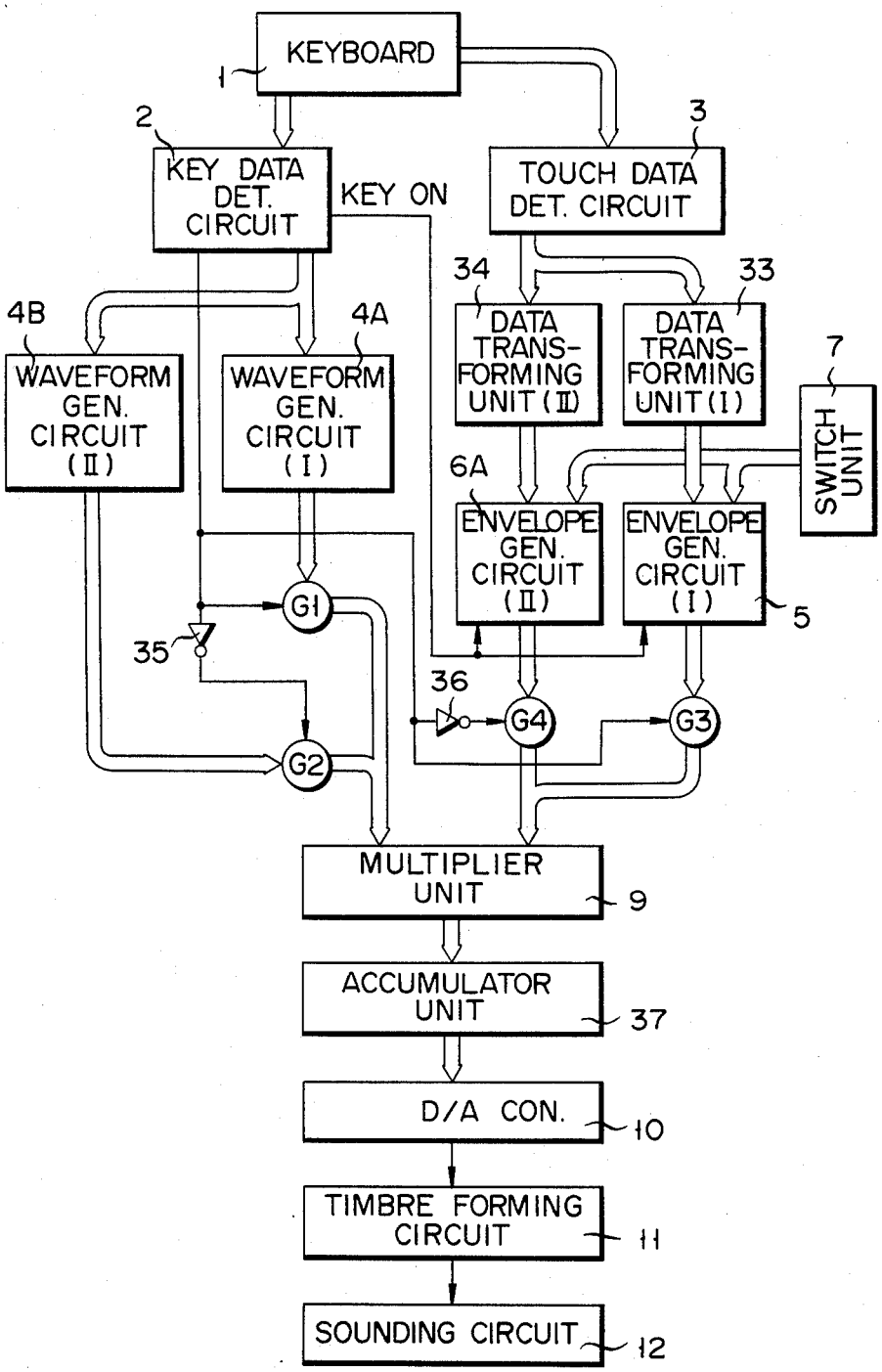

A fourth embodiment of the invention will now be described with reference to FIGS. 31 through 36. This embodiment is a combination of the second and third embodiments. Parts like those in the second and third embodiments are designated by like reference numerals, and their description is omitted. FIG. 31 shows the circuit of the fourth embodiment. As is shown, first and second waveform generating circuits 4A and 4B are provided in correspondence to respective first and second envelope generating circuits 5A and 6A like the second embodiment. A first data transforming unit 33 having a transformation characteristic represented by curve I in FIG. 15 is provided for the envelope generating circuit 5A. A second data transforming unit 34 having the transformation characteristic represented by curve II in FIG. 15 is provided for the second envelope generating circuit 6A. The first and second waveform generating circuits 4A and 4B generate respective waveforms of FIGS. 27A and 27B. These waveforms are modified with envelope waveforms variable according to the touch response.

Figure 32:
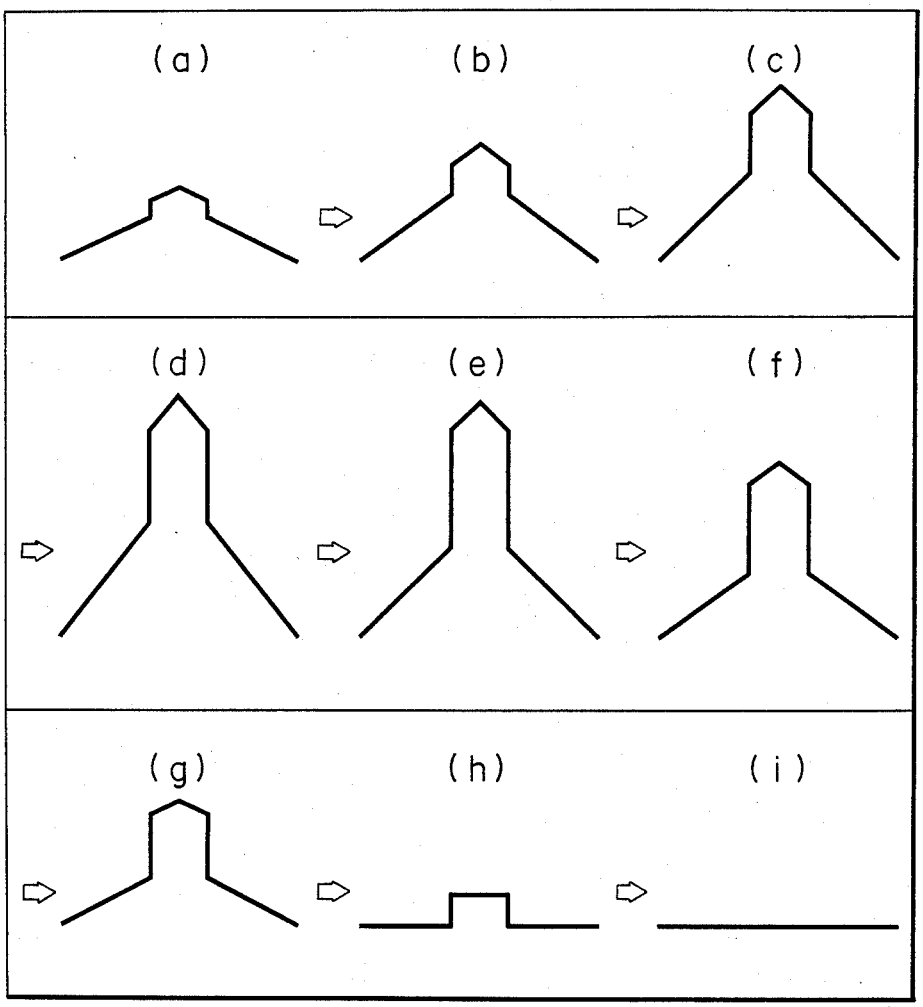
Figure 33:
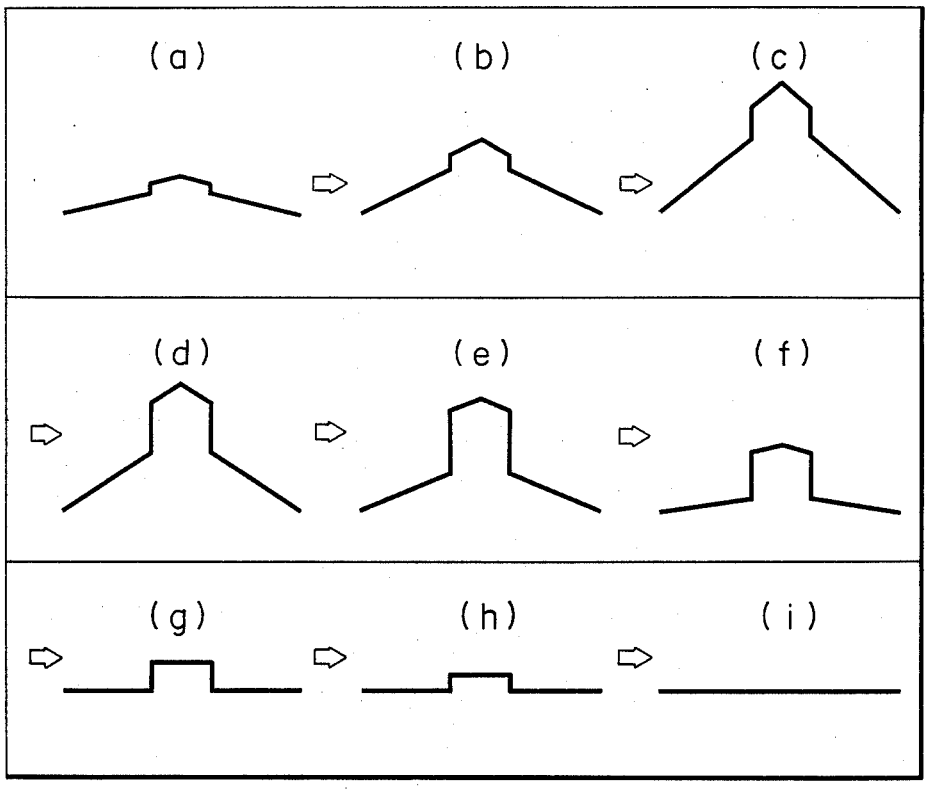
Figure 34:
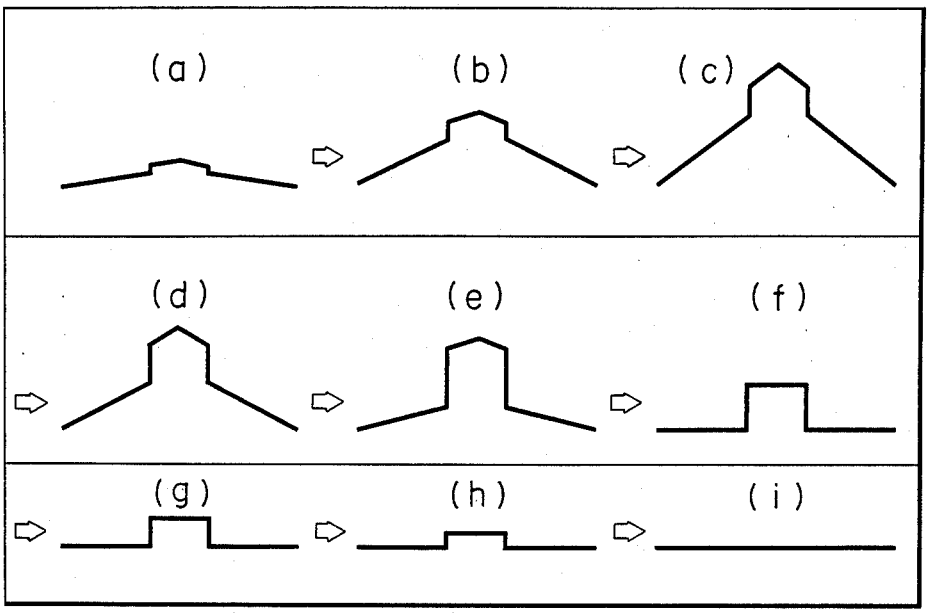
Figure 35:
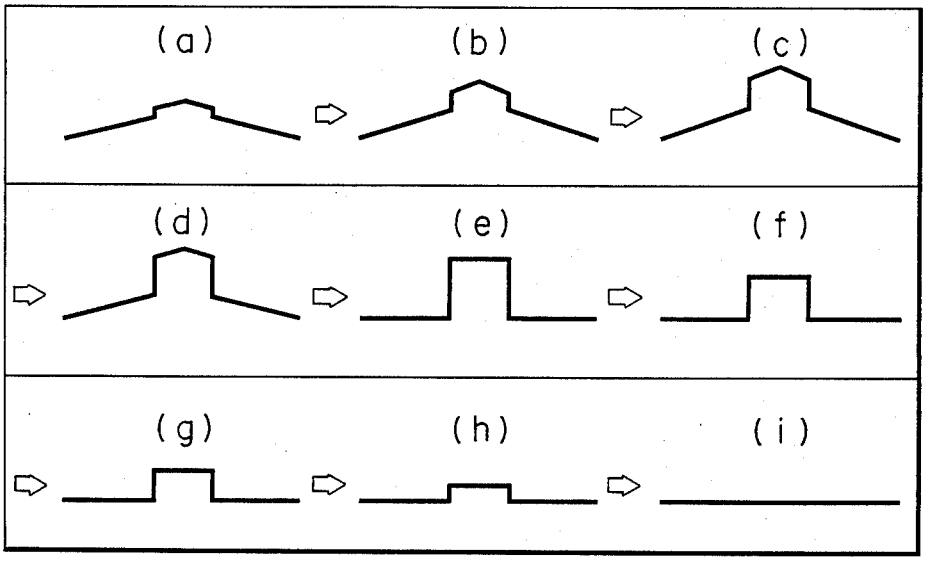
Figure 36:
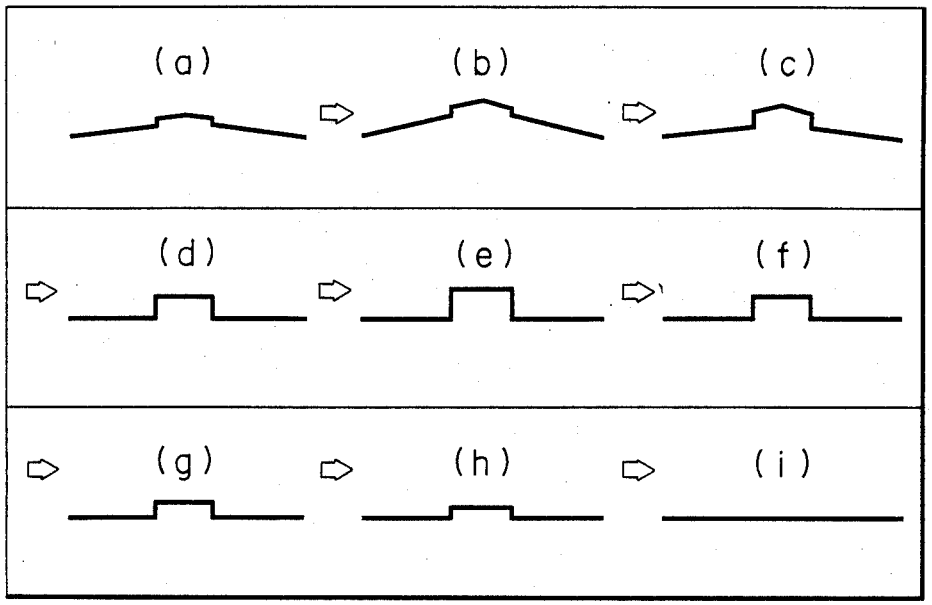

The operation will now be described in conjunction with a case where the waveforms of FIGS. 27A and 27B are modified with the envelope waveforms of FIGS. 4A and 4B according to the touch response. First, the envelope waveforms of FIGS. 4A and 4B are set by switching timbre switches in the switch unit 7 shown in FIG. 31. When a key is depressed strongly, modification with the envelope waveforms is performed in the manner as described to obtain a tone variation as shown in FIG. 32. More specifically, the first and second data transforming units 33 and 34 provide maximum transformation data, as is seen from FIGS. 15.

FIGS. 33, 34, 35 and 36 show tone waveform variations in respective cases when the key is depressed a little strongly, moderately, a little weakly and weakly. In either of these cases, the tone is varied according to the transformation characteristics shown in FIG. 15 and the envelope waveforms of FIGS. 4A and 4B. It will be understood that in the fourth embodiment the individual two tone waveforms are modified according to the respective envelope waveforms that are both variable according to the touch response, and resultant modifications of waveforms are combined to obtain a tone, the volume and timbre of which are both varied according to the touch response.

In the previous first embodiment, the attack time Ta of the envelope waveform of FIG. 4A is varied according to the touch resonse with a constant slope of the attack level. Conversely, it is possible to permit variation of the attack level slope while keeping a constant attack time Ta or permit variation of both these two. Further, while two different envelope waveforms have been used to control the modifications of one waveform consisting of a plurality of steps, it is possible to use three or more different envelope waveforms. Furthermore, it is possible to provide three or more waveform generating circuits for combining three or more waveforms. Moreover, data transforming units and envelope generating circuits may be provided in number corresponding to three or a greater number of waveform generating circuits.

As has been described in the foregoing, according to the invention waveform data read out for each of a plurality of waveform steps is modified using a plurality of different envelope waveforms, and at least one of these envelope waveforms is controlled according to touch data representing the way of key operation, e.g., the speed thereof. Thus, it is possible to obtain tones with both the volume and timbre thereof variable according to the touch response of the keyboard. This permits generation of tones capable of arousing richer musical sentiment than in the prior art.

What is claimed is:

1. A tone generating apparatus comprising:

means for sequentially outputting a plurality of waveform data constituting one waveform period, each waveform data representing one of the portions of a waveform;

means for setting a plurality of timbre data corresponding to at least one designated timbre;

means coupled to said timbre data setting means for generating a plurality of different envelope waveforms;

means for generating touch data in accordance with a way of operation of performance keys;

means for controlling at least one of said plurality of different envelope waveforms as a function of said touch data; and means for selectively allotting said envelope waveforms for each of the waveform portions so as to obtain a tone data by adapting an allotted envelope waveform to a waveform data corresponding to the waveform portion.

2. The tone generating apparatus according to claim 1, wherein said envelope waveform generating means includes:

a decoder coupled to said timbre data setting means for decoding said timbre data;

means for generating an envelope clock according to the output of said decoder;

means for counting said envelope clock; and means for comparing the count contents of said counting means and said touch data.

3. The tone generating apparatus according to claim 2, which further comprises:

transforming means coupled to an output terminal of said touch data generating means for transforming said touch data to a plurality of different touch data; and means for supplying said plurality of different touch to said envelope waveform data generating means for generating a plurality of modified envelope waveform data.

4. A tone generating apparatus comprising:

means for sequentially outputting a plurality of waveform data constituting one waveform period, each waveform data representing one of portions of a waveform;

means for generating a plurality of different envelope waveforms;

means for generating touch data in accordance with a way of operation of performance keys;

means for controlling at least one of said plurality of different envelope waveforms as a function of said touch data; and means for selectively allotting said envelope waveforms for each of the waveform portions so as to obtain a tone data by adapting an allotted envelope waveform to a waveform data corresponding to the waveform portion.

* * * * *